US007156706B2

(12) United States Patent
Brown et al.

(10) Patent No.: US 7,156,706 B2
(45) Date of Patent: Jan. 2, 2007

(54) CONTACT HAVING MULTIPLE CONTACT BEAMS

(75) Inventors: John Bossert Brown, Ann Arbor, MI (US); Matthew Richard McAlonis, Elizabethtown, PA (US); Justin Shane McClellan, Camp Hill, PA (US); David Charles Martin, Mechanicsburg, PA (US); Attalee S. Taylor, Palmyra, PA (US); Troy Everette Conner, York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 74 days.

(21) Appl. No.: 10/624,856

(22) Filed: Jul. 22, 2003

(65) Prior Publication Data

US 2005/0020146 A1 Jan. 27, 2005

(51) Int. Cl.
*H01R 4/48* (2006.01)
*H01R 12/00* (2006.01)

(52) U.S. Cl. ..... 439/862; 439/66

(58) Field of Classification Search ..... 439/66, 439/862, 74, 500, 636, 638
See application file for complete search history.

(56) References Cited

U.S. PATENT DOCUMENTS

| | | | | |
|---|---|---|---|---|
| 4,737,115 | A * | 4/1988 | Seidler | 439/83 |
| 5,378,160 | A * | 1/1995 | Yumibe et al. | 439/66 |
| 5,865,643 | A * | 2/1999 | Suzuki | 439/500 |
| 6,077,130 | A * | 6/2000 | Hughes et al. | 439/862 |
| 6,575,774 | B1 * | 6/2003 | Ling et al. | 439/108 |
| 6,663,445 | B1 * | 12/2003 | Yeh | 439/862 |
| 6,688,893 | B1 * | 2/2004 | Huang et al. | 439/66 |
| 6,758,702 | B1 * | 7/2004 | Johnescu | 439/862 |

* cited by examiner

*Primary Examiner*—Hien Vu

(57) ABSTRACT

An electrical socket is provided that holds an array of contacts. Each contact includes first and second contact elements that are configured to be joined in an electrically common manner. The first and second contact elements have first and second contact beams, respectively, that are oriented to project toward one another and to overlap. The first and second contact elements each have base portions that are formed separate from one another and are configured to be joined to a common conductive path on the circuit board.

20 Claims, 6 Drawing Sheets

CONTACT HAVING MULTIPLE CONTACT BEAMS

BACKGROUND OF THE INVENTION

The present invention generally relates to a surface mount contact configured to be carried in an electrical component, such as a socket. More particularly, the present invention relates to a surface mount contact which has multiple contact beams.

Contacts are used in a variety of applications to connect conductive members, such as processors, circuit boards and the like. In many applications, the contacts are held in a housing such as a socket. For example, a socket is generally used to connect a processor to a circuit board. The typical socket includes a body having cavities that carry several flexible contacts. A land grid array (LGA) socket holds the contacts that have a flexible body formed at one end with a contact beam and attached at an opposite end to a solder ball. The contact beam extends upward from the cavity above the top surface of the body of the socket, while the solder ball extends downward from the cavity below the bottom surface of the body. The cavities are arranged in an array and the contacts are oriented with all of the contact beams extend from the cavities in the same direction such that the contact beams in each row are aligned with one another. The solder balls attached to the contacts are soldered to electrical traces on the circuit board. The processor has several contact pads on its bottom surface and the processor is positioned on the socket such that each contact pad is aligned with a corresponding single contact beam. The processor is compressed downward onto the socket with each contact beam engaging a corresponding contact pad.

As technology advances, contacts are needed that can carry data signals at faster rates and that are more responsive to state transitions in the data signal. Sockets are also needed that are more reliable and can be manufactured at lower costs. The ability to improve these factors is affected by the socket size, as well as the internal electrical performance of the socket, such as the inductance and resistance exhibited by the contacts. A reduction in socket size allows smaller printed wiring boards to be used and creates shorter circuit paths which aid state transition response time.

Conventional sockets suffer from several drawbacks. The contacts are large and take up a large amount of space within the socket. The socket thus carries a limited number of contacts and has a limited capacity to transmit signals between the processor and the circuit board. Additionally, the contact beams are limited in size and length in order that the contact beams do not touch contact beams in the same or different rows when deflected by the processor. Short and/or small contact beams have a more limited range of vertical deflection that longer and/or larger contact beams. If the shorter, smaller contact beams are overly deflected, they become permanently deformed. Larger, longer contact beams may require too much force to be properly joined to the processor.

Further, each contact beam creates a local electromagnetic (EM) field when it carries data signals. As the contact beams are positioned closer and closer, the EM fields begin to interfere with the performance of adjacent contact beams. This interference appears as an increase in the inductance of the contacts. As inductance increases, the contacts in the socket respond more slowly to transitions in the voltage level of signals carried through the socket. Hence, while a data signal output from the processor to a contact may switch voltages (or states) in a few micro seconds, once the data signal passes through the corresponding contact in the socket, the data signal changes states over a longer period of time. It is desirable to limit the inductance exhibited by contacts to maintain the ability to quickly respond to state changes.

Moreover, as contacts are made smaller, electrical signals encounter more resistance when traveling through the contacts and thus the socket. High resistance causes the contacts to generate heat as electrical signals pass therethrough which can damage surrounding parts and shorten product life. Additionally, more energy is required to convey electrical signals through high resistance contacts which causes the electronic device to consume more energy.

A need exists for a socket and contact that addresses the above noted problems and others experienced heretofore.

BRIEF DESCRIPTION OF THE INVENTION

An electrical socket is provided that holds an array of contacts. Each contact includes first and second contact elements that are configured to be joined in an electrically common manner. The first and second contact elements have first and second contact beams, respectively, that are oriented to project toward one another and are positioned adjacent one another. The first and second contact elements each have base portions that are formed separate from one another and are configured to be joined to a common conductive path on a circuit member.

Optionally, the first and second contact elements may each be formed with a pair of contact beams, where each pair of contact beams is formed with a corresponding base portion. The pairs of contact beams are oriented to face one another and to extend between one another in an overlapping manner without directly contacting one another. The contact beams are oriented to convey current along corresponding parallel first and second paths in a common plane. The first and second paths are associated with the first and second contact beams, respectively, and are directed in opposite directions within the common plane.

In accordance with at least one alternative embodiment, a contact formed in accordance with the manner described above is provided for use in a connector or other electrical device such as a socket.

Figure 1:
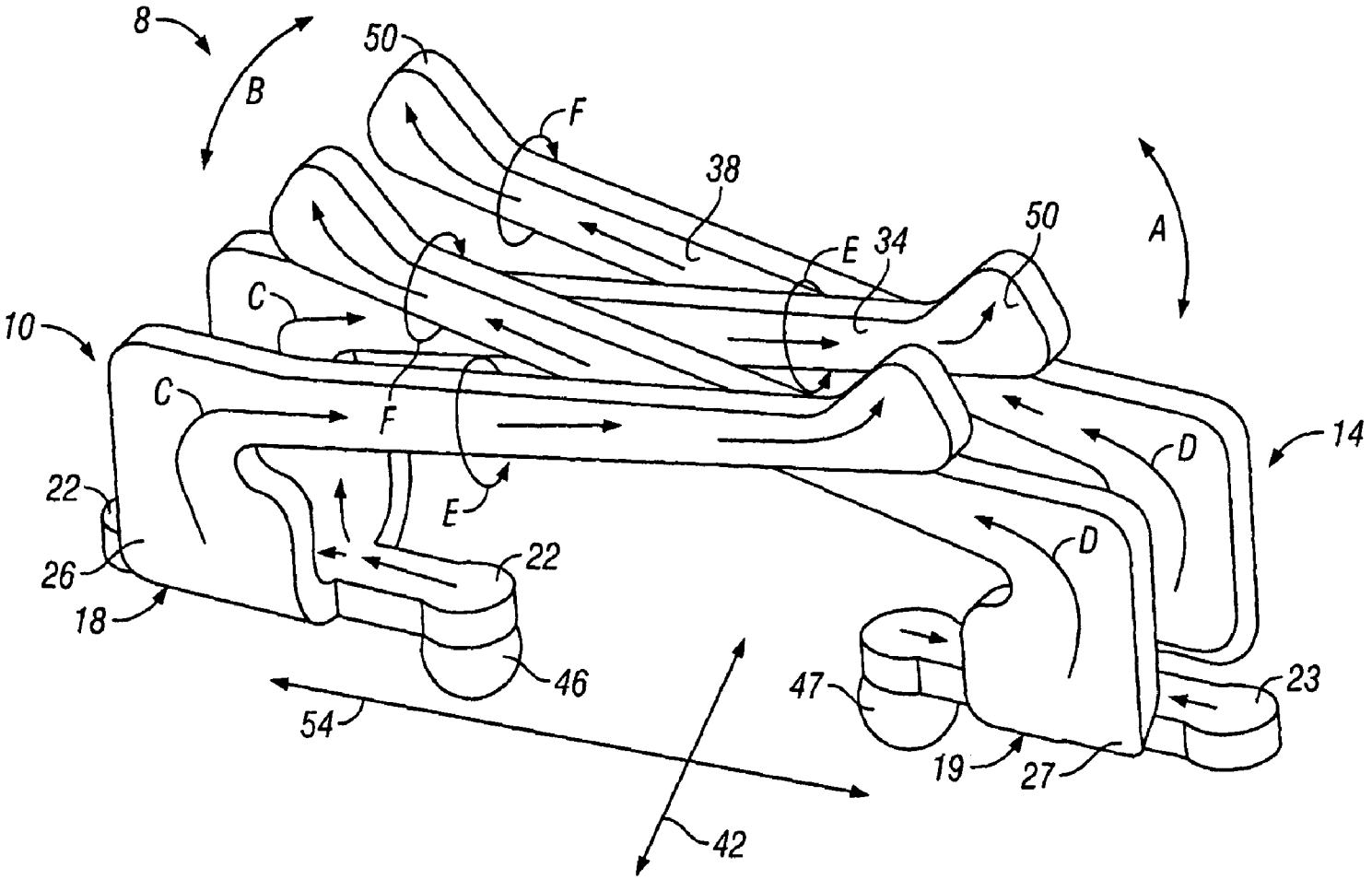
FIG. 1 illustrates a symmetrical view of a contact formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates an isometric view of a contact 8 having contact elements 10 and 14 arranged in an interleaved, overlapping manner according to an embodiment of the present invention. The contact elements 10 and 14 having base portions 18 and 19 with solder ball paddles 22 and 23 on opposite sides thereof. The solder ball paddles 22 and 23 carry solder balls 46 and 47. The solder ball paddles 22 and 23 comprise flexible termination leads having pads on the outer ends thereof. Optionally, the base portions 18 and 19 may have more or fewer than two solder ball paddles 22 and 23. As shown in FIG. 1, the base portions 18 and 19 are arranged parallel to a longitudinal axis 54. The contact elements 10 and 14 each have support plates 26 and 27 formed on opposite sides of the base portions 18 and 19. Contact beams 34 and 38 are formed with the support plates 26 and 27, respectively, and are thin, flexible and oriented in parallel planes. The contact beams 34 and 38 are formed to normally extend vertical at an acute angle upward from a longitudinal axis 54. The contact beams 34 and 38 have upturned outer contact portions 50. The contact beams 34 of the contact element 10 flex upward and downward along arrow A, while the contact beams 38 of the contact element 14 flex along arrow B.

The contact beams 34 of the contact element 10 extend toward the contact beams 38 of the contact element 14. The contact beams 34 and 38 of the contact elements 10 and 14 overlap, and are interleaved with, each other along a transverse axis 42. For example, one contact beam 34 of the contact element 10 is positioned between a pair of contact beams 38 of the contact element 14 and one contact beam 38 of the contact element 14 is positioned between a pair of contact beams 34 of the contact element 10.

The base portions 18 and 19 of the contact elements 10 and 14 are soldered to a common pad 9 or electrically joined traces on a circuit board 7. A processor (which is then positioned on a socket containing the contact elements 10 and 14), has one or more electrically common contact pads on the bottom surface of the processor that engage the contact portions 50 of the contact elements 10 and 14. The weight of the processor pushes the contact beams 34 of the contact element 10 downward along arrow A, and the contact beams 38 of the contact element 14 downward along arrow B. The contact beams 34 and 38 of the contact elements 10 and 14 may be deflected downward, for example, until aligned in a common plane, as well as parallel with each other and with the longitudinal axis 54.

In operation, electrical current travels through the contact elements 10 and 14 between the circuit board 7 and the processor. When signals are conveyed from the circuit board 7 to the processor, the current flows in the direction of arrow C from the base portion 18 to the contact portions 50 of the contact beams 34. In the contact element 14, the current flows in the direction of arrows D from the base portion 19 to the contact portions 50 of the contact beams 38. As current travels through the contact elements 10 and 14, electromagnetic (EM) fields are created about the corresponding contact beams 34 and 38. However, because the contact beams 34 and 38 of the contact elements 10 and 14 are interleaved and overlap along the transverse axis 42 and face one another, adjacent contact beams 34 and 38 carry current in opposite directions.

As the current flows in opposite directions (e.g., see arrows C and D) in adjacent contact beams 34 and 38, adjacent EM fields are created of equal amplitude that rotate in opposite directions. By way of example only, FIG. 1 illustrates EM field lines E and F that are located about contact beams 34 and 38, respectively. The contact beams 34 and 38 have similar cross-sectional dimensions and each carry an equal current. Hence, EM field lines E and F have equal amplitude, yet rotate in opposite directions. Consequently, the EM fields created by contact beams 34 and 38 offset and cancel out one another.

As noted above, multiple contact elements 10 and 14 are joined to one or more electrically common pads 9 or traces on the circuit board 7 at a plurality of solder ball paddles 22 and 23. Hence, all of the contact beams 34 and 38 in the contact 8 operate in parallel. This parallel operation enables each individual contact beam 34 and 38 to be small, while the contact beams 34 and 38 of a single contact 8 collectively operate to afford a low resistance connection between the processor and circuit board. Therefore, electrical signals encounter less resistance when traveling through the contact 8 and create less heat and require less energy.

Overlapping contact beams 34 and 38 in an interleaved manner increase the usable space within the socket and allow for more contacts 8 to be used in a socket because adjacent contact elements 10 and 14 within the socket are located in the same space without engaging each other. Therefore, larger and longer contact beams 34 and 38 may be used in each contact 8 without touching a neighboring contact beam 34 or 38. Thus, the contact beams 34 and 38 have a larger vertical deflection range to accommodate tolerance issues between the processor and the contacts 8.

Figure 2:
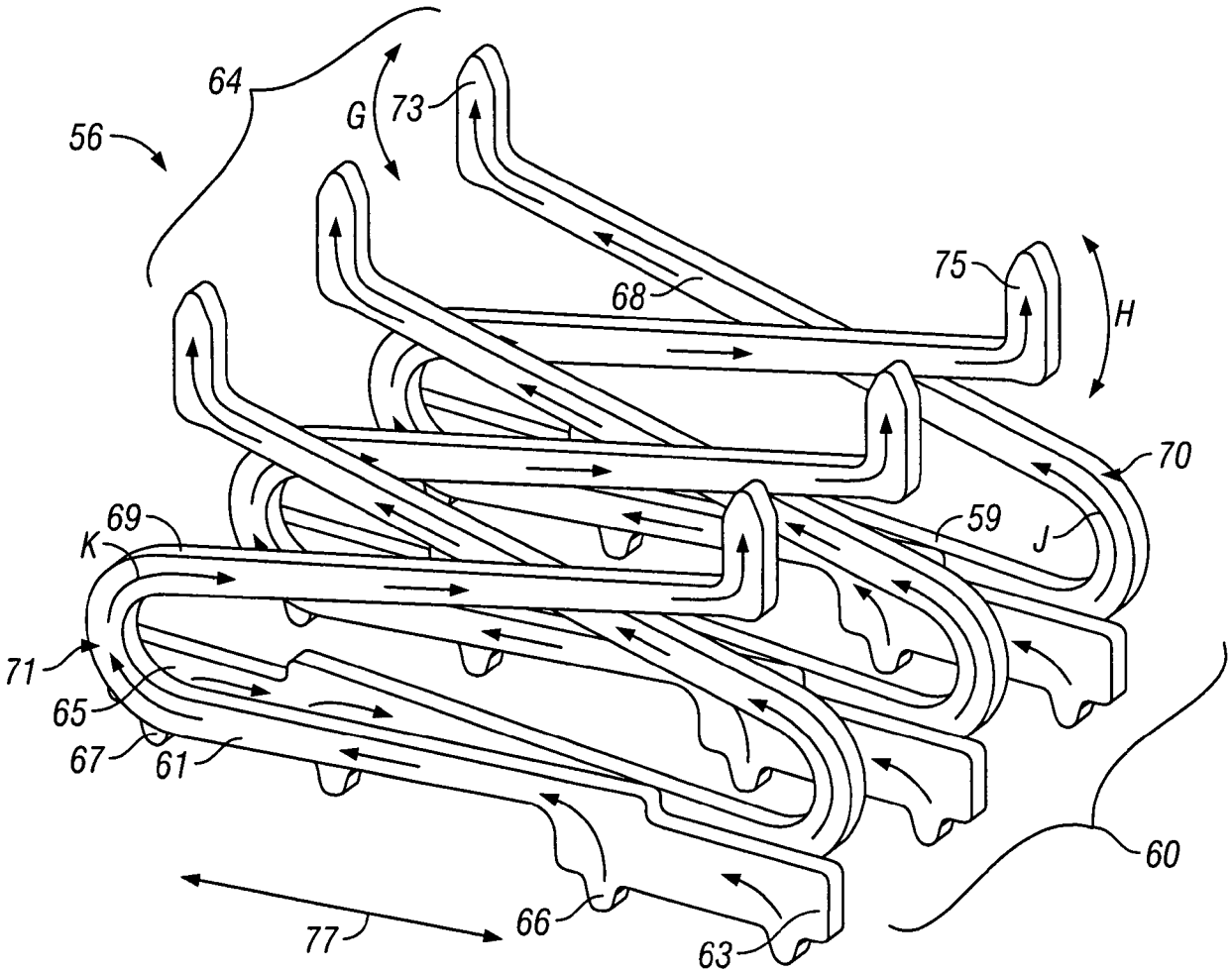
FIG. 2 illustrates a symmetrical view of a contact formed in accordance with an alternative embodiment of the present invention.

FIG. 2 illustrates an isometric view of a contact 56 formed in accordance with an alternative embodiment. The contact 56 includes first and second sets of contact elements 60 and 64, respectively. The first and second sets of contact elements 60 and 64 face one another and are arranged in an overlapping, interleaved manner accordance to an embodiment of the present invention. The contact elements 60 and 64 have planar base portions 63 and 65 with prongs 66 and 67, respectively, extending downward therefrom. The first and second sets of contact elements 60 and 64 have contact beams 70 and 71, respectively, formed with, and extending from, the base portions 63 and 65.

The contact beams 70 and 71 are U-shaped with lower arms 59 and 61 joining the base portions 63 and 65, respectively. Upper arms 68 and 69 of each contact beam 70 and 71 join contact tips 73 and 75, respectively. The contact tips 73 and 75 are bent upward from the upper arms 68 and 69 of the contact beams 70 and 71 to engage contact pads, traces or pins on a processor. The upper arms 68 and 69 of the contact beams 70 and 71 extend upward at an acute angle from a longitudinal axis 77 of the contact 56. The contact tips 73 and 75 flex along arrows G and H, respectively.

The contact 56 of FIG. 2 operates similarly to the contact 8 of FIG. 1. Multiple contacts 56 are loaded in a socket. The socket is positioned on a circuit board, the prongs 66 and 67 are press fit into holes or soldered to electrical pads or traces on the circuit board. The processor is then positioned on the socket with contact pads on the bottom surface of the processor engaging the contact tips 73 and 75 on the contact beams 70 and 71. The weight of the processor pushes the contact tips 73 and 75 downward along arrows G and H until the upper arms 68 and 69 are horizontally aligned and parallel with, each other and the longitudinal axis 77.

The contact elements 70 and 71 are formed separate from one another, yet organized in an interleaved order and arranged facing one another. Once the prongs 66 and 67 are joined to a circuit board, all of the contact elements 70 and 71 in contact 56 are electrically common with one another. Arrows J and K denote the direction of current flow as electrical signals are passed from the circuit board to the processor. Current flows in opposite directions within adjacent contact elements 70 and 71, thereby creating adjacent EM fields which offset and cancel out one another.

Figure 3:
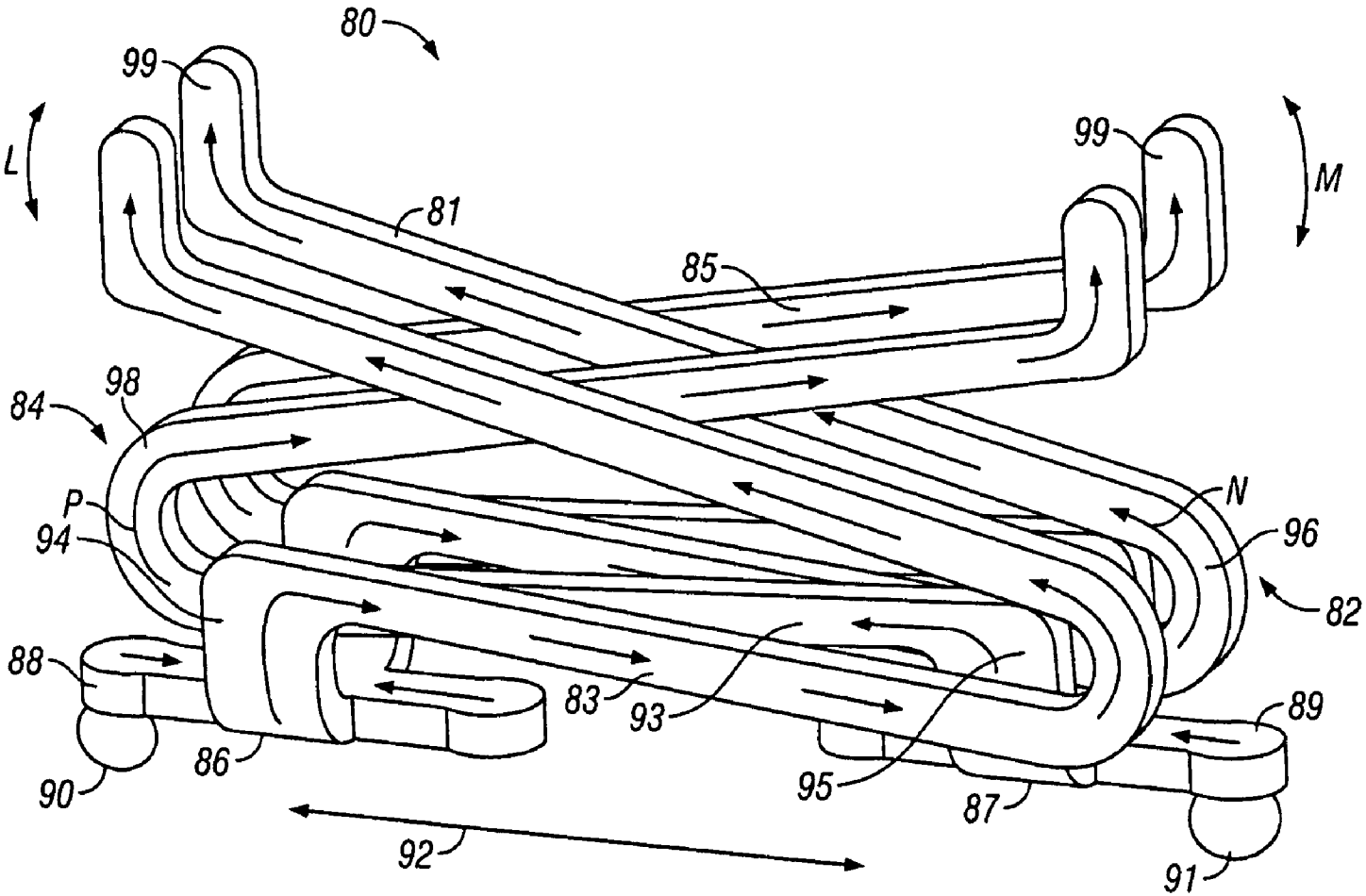
FIG. 3 illustrates a contact formed in accordance with yet a further alternative embodiment of the present invention.

FIG. 3 illustrates an isometric view of a contact 80 having contact elements 82 and 84 arranged in an overlapping, interleaved manner according to an embodiment of the present invention. The contact elements 82 and 84 have base portions 86 and 87, respectively, with solder ball paddles 88 and 89 on opposite sides thereof. The solder ball paddles 88 and 89 carry solder balls 90 and 91. Optionally, the base portions 86 and 87 may have more than two solder ball paddles 88 and 89. The base portions 86 and 87 are aligned parallel to a longitudinal axis 92. The contact elements 82 and 84 have support plates 94 and 95 formed on opposite sides of the base portions 86 and 87, respectively.

Contact beams 96 and 98 extend from the support plates 94 and 95 in an overlapping and facing manner. The contact beams 96 and 98 are U-shaped with upper arms 81 and 85, lower arms 83 and 93. The upper arms 81 and 85 extend at an acute angle to the longitudinal axis 92. The upper arms 81 and 85 include contact tips 99. The upper arms 81 and 85 of the contact elements 82 and 84 flex along arrows L and M, respectively. The current flows in the direction of arrows N and P when signals are passed from the circuit board to the processor to form offsetting EM fields.

Figure 4:
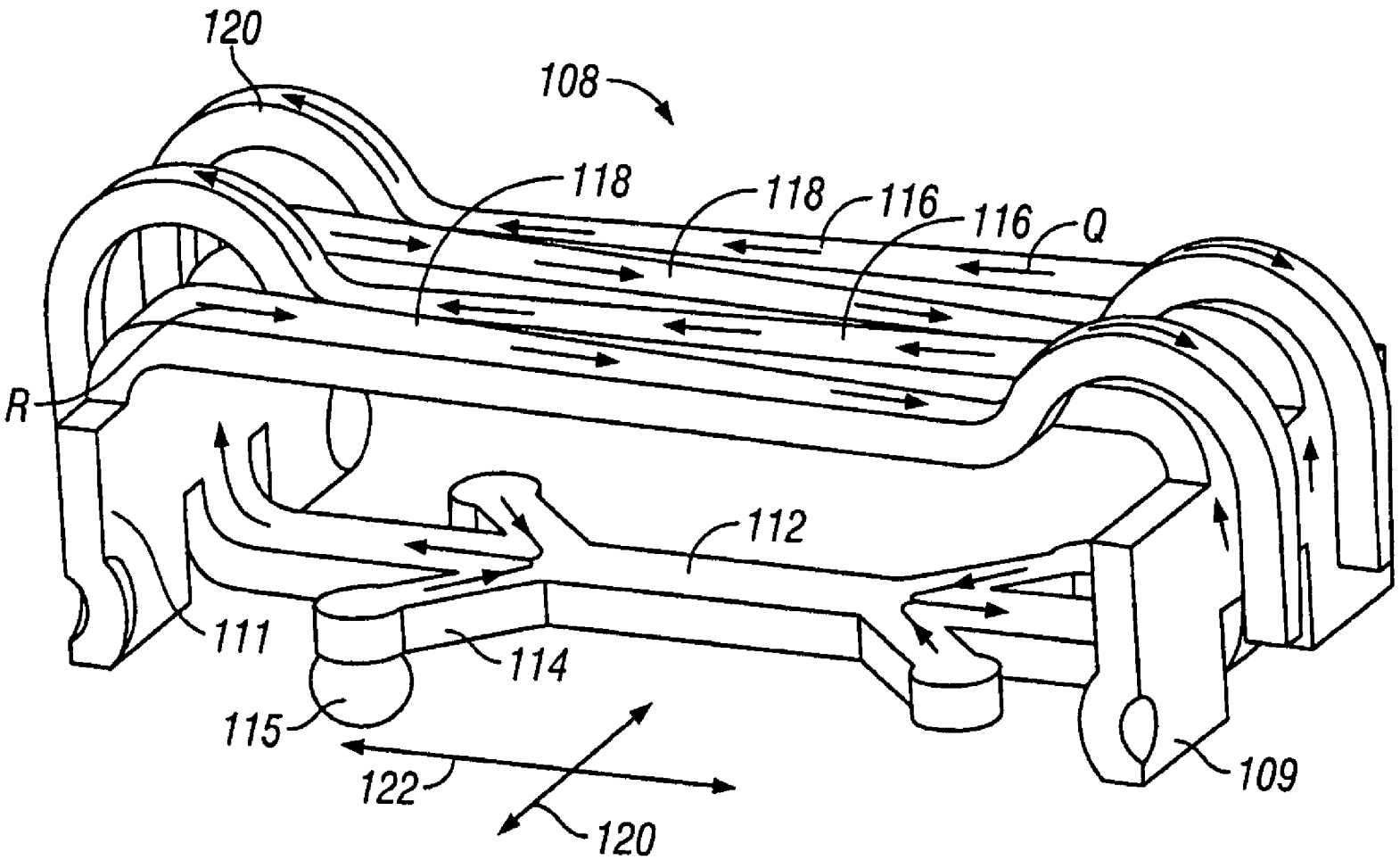
FIG. 4 illustrates a contact formed in accordance with an even further alternative embodiment of the present invention.

FIG. 4 illustrates an isometric view of a contact 108 formed according to an embodiment of the present invention. The contact 108 includes opposite end walls 109 and 111 that are joined by a center beam 112. The center beam 112 has solder ball paddles 114 extending from opposite sides thereof. The solder ball paddles 114 carry solder balls 115 (only one is shown). Contact beams 116 and 118 extend from the end walls 109 and 111, respectively. The contact beams 116 and 118 are oriented parallel to each other. The contact beams 116 and 118 have arched contact portions 120 on outer ends thereof. The contact portions 120 extend beyond and hang over the end walls 109 and 111.

The contact beams 116 extend from the end wall 109 toward the opposite end wall 111 and the contact beams 118 extend from the end wall 111 toward the opposite end wall 109. The first contact beams 116 and 118 overlap each other along a transverse axis 120.

The embodiment of FIG. 4 operates similarly to the embodiments of FIGS. 1–3. The contact beams 116 and 118 are flexible and configured to be deflected by a processor or other component until in a horizontal alignment and parallel with each other and with a longitudinal axis 122. In the contact 108, the current flows in the direction of arrows Q and R through the contact beams 116 and 118 as signals are carried from the circuit board to the processor. The EM fields created by contact beams 116 and 118 cancel out one another.

Figure 5:
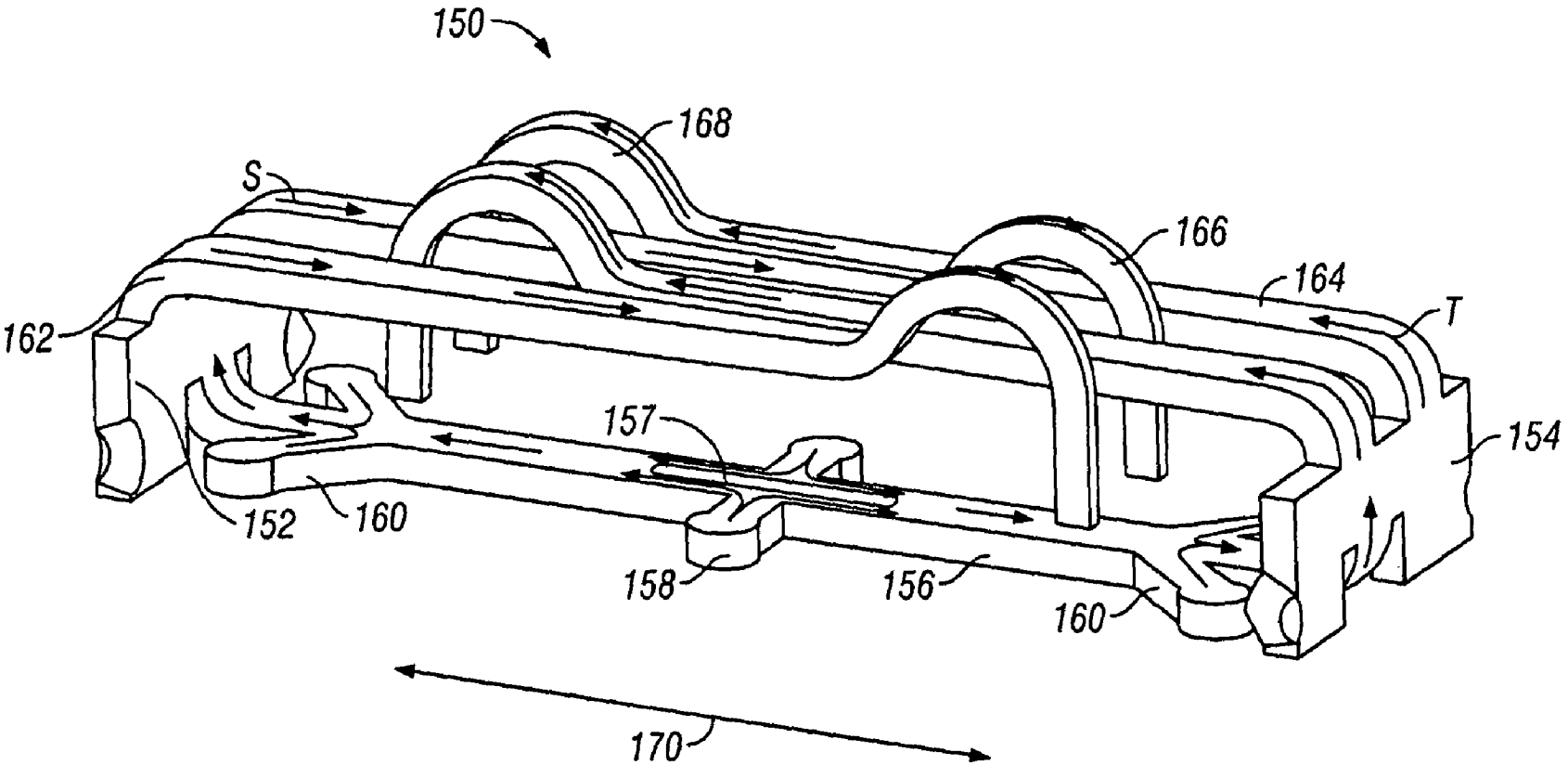
FIG. 5 illustrates a contact formed in accordance with an alternative embodiment of the present invention.

FIG. 5 illustrates an isometric view of a contact 150 formed according to an alternative embodiment of the present invention. The contact 150 includes rectangular end walls 152 and 154 on opposite ends thereof and is generally made of a conductive material such as a copper alloy. Each end wall 152 and 154 has at least one flexible contact beam 162 and 164, respectively, that projects from a top edge of the end wall 152 and 154. The contact beams 162 and 164 are bent to extend toward the opposite end wall 154 and 152. As shown in FIG. 5, the contact beams 162 and 164 are oriented parallel to one another along a longitudinal axis 170 of the contact 150. Each contact beam 162 and 164 has an elbow at one end that is formed with the end wall and has a contact arch 166 and 168 at an opposite end. Each contact beam 162 and 164 may be flexed about the elbows. The contact beams 162 and 164 are interleaved with each other such that a contact beam 162 extending from end wall 152 is located between contact beams 164 extending from the other end wall 154, and vice versa. Current flows in the directions denoted by arrows S and T when carrying signals from a circuit board to a processor.

Each end wall 152 and 154 has a curved arm formed with a thin center beam 156. The center beam 156 extends parallel to the longitudinal axis 170 between the end walls 152 and 154. The center beam 156 includes a slot 157 cut in the center thereof to form thin side walls on opposite sides of the slot 157. The center beam 156 includes center termination leads 158 extending perpendicularly from opposite sides of the center beam 156. The center termination leads 158 are formed with circular pads on outer ends thereof that carry solder balls (not shown). End termination leads 160 are provided on opposite ends of the center beam 156 proximate the end walls 152 and 154. The end termination leads 160 extend laterally from the center beam 156 at an acute angle, such as a generally 45 degree angle, to the longitudinal axis 170 and toward the nearest end wall 152 and 154. The end termination leads 160 also are formed with circular pads that carry the solder balls (not shown).

Figure 6:
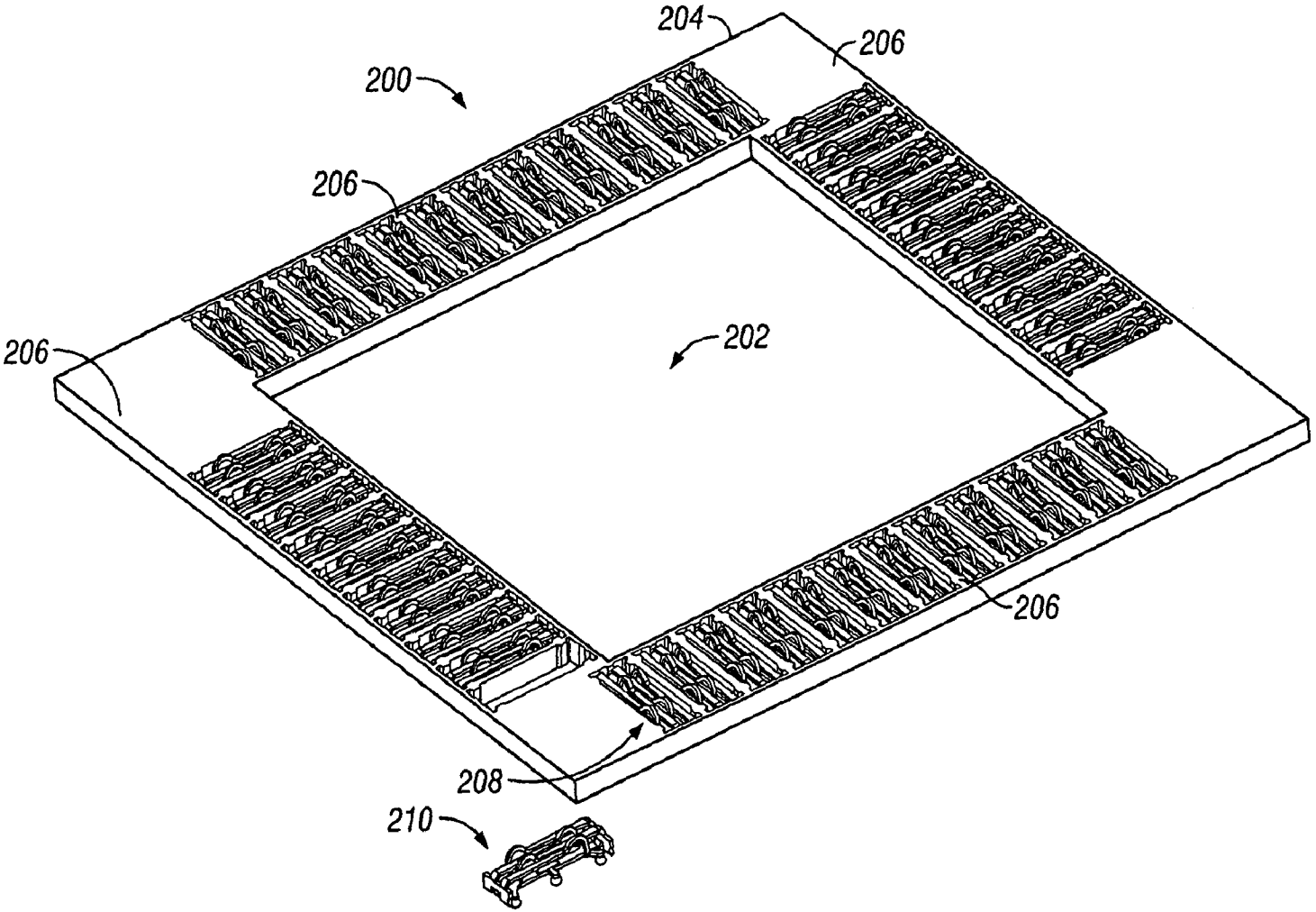
FIG. 6 illustrates a symmetrical view of a socket configured to hold contacts in accordance with an embodiment of the present invention.

FIG. 6 illustrates an isometric view of an electrical socket 200 having an opening 202 through the center thereof. The socket 200 includes a housing 204 which is comprised of side portions 206. Each side portion 206 includes at least one row of cavities 208 that are arranged side by side and oriented to extend toward the opening 202 proximate the center of the socket 200. Each cavity 208 receives a corresponding contact 210.

Optionally, the contacts need not be configured to be surface mounted to a circuit board. Instead, the contacts may be configured to be pressed into through-holes in a conductive member.

Optionally, the contacts may not be loaded into a socket, but instead may be held in a connector housing or mounted directly on a circuit board separate and apart from a socket or other connector housing.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical contact, comprising:

first and second contact elements configured to be joined in an electrically common manner, said first and second contact elements having first and second base portions that are joined to first and second contact beams, respectively, said first and second base portions being spaced apart from one another, said first and second beams extending from said first and second base portions and projecting toward one another in an overlapping pattern, wherein said first and second contact beams carry equal currents in opposite directions such that electromagnetic fields about said first and second contact beams created by the currents offset and cancel out one another.

2. The electrical contact of claim 1, wherein said first and second base portions are formed separate from one another and are configured to be joined to a common conductive path on a circuit board.

3. The electrical contact of claim 1, wherein said first and second base portions are positioned proximate opposite ends of said contact along a longitudinal axis of said contact.

4. The electrical contact of claim 1, wherein said first and second base portions are formed separate from one another.

5. The electrical contact of claim 1, wherein said first and second contact beams axe oriented to convey the equal currents along first and second paths that are aligned in substantially parallel vertical planes, said first and second paths being directed in opposite directions within said parallel planes.

6. The electrical contact of claim 1, further comprising first and second sets of said first and second contact elements that are separately formed and configured to be separately joined to a circuit board.

7. The electrical contact of claim 1, wherein said first and second base portions each have one of prongs and solder paddles configured to be joined to a circuit board.

8. The electrical contact of claim 1, wherein said first and second contact elements each are U-shaped with upper and lower arms having outer ends that are configured to engage a circuit board to processor.

9. An electrical contact, comprising:

first and second contact elements configured to be joined in an electrically common manner, said first and second contact elements having first and second contact beams, respectively, that are oriented to project toward one another in an overlapping pattern, wherein said first contact beam includes at least a pair of contact beams formed with a common base portion, said second contact beam extending between said pair of contact beams in an overlapping manner without directly contacting one another.

10. An electrical contact comprising:

first and second contact elements configured to be joined in an electrically common manner, said first and second contact elements having first and second base portions that are joined to first and second contact beams, respectively, said first and second base portions being spaced apart from one another, said first and second beams extending from said first and second base portions and projecting toward one another in an overlapping pattern, wherein said first contact element includes a first pair of contact beams oriented in parallel planes and said second contact element includes a second pair of contact beams oriented in parallel planes, said first and second pairs of contact beams projecting toward one another in an alternating, interleaved order.

11. An electrical socket, comprising:

a housing;

a plurality of contacts held in said housing, each contact including at least first and second contact elements configured to be joined in an electrically common manner, said first and second contact elements having first and second base portions that are joined to first and second contact beams, respectively, said first and second base portions being spaced apart from one another, said first and second beams extending from said first and second base portions and projecting toward one another in an overlapping pattern, wherein said first and second contact beams carry equal currents in opposite directions such that electromagnetic fields about said first and second contact beams created by the currents offset and cancel out one another.

12. The electrical socket of claim 11, wherein said first and second base portions are formed separate from one another and are configured to be joined to a common conductive path on a circuit board.

13. An electrical socket, comprising:

a housing; and a plurality of contacts held in said housing, each contact including at least first and second contact elements configured to be joined in an electrically common manner, said first and second contact elements having first and second contact beams, respectively, that are oriented to project toward one another in an overlapping pattern, wherein said first contact beam includes at least a pair of contact beams formed with a common base portion, said second contact beam extending between said pair of contact beams in an overlapping manner without directly contacting one another.

14. The electrical socket of claim 11, wherein said first and second base portions are positioned proximate opposite ends of said contact along a longitudinal axis of said contact.

15. The electrical socket of claim 11, wherein said first and second base portions are formed separate from one another.

16. The electrical socket of claim 11, wherein said first and second contact beams are oriented to convey the equal currents along first and second paths that are aligned in substantially parallel planes, said first and second paths being directed in opposite directions within said parallel planes.

17. The electrical socket of claim 11, further comprising first and second sets of said first and second contact elements that are separately formed and configured to be separately joined to a circuit board.

18. The electrical socket of claim 11, wherein said first and second base portions each have one of prongs and solder paddles to be joined to a circuit board.

19. The electrical socket of claim 11, wherein said first and second contact elements each are U-shaped with upper and lower arms having outer ends that are configured to engage a circuit board and processor.

20. An electrical contact, comprising:

first and second contact elements configured to be joined in an electrically common manner, said first and second contact elements having first and second base portions that are joined to first and second contact beams, respectively, said first and second base portions being spaced apart from one another, said first and second beams extending from said first and second base portions and projecting toward one another in an overlapping pattern, wherein said first contact element includes a first pair of contact beams oriented in parallel planes and said second contact element includes a second pair of contact beams oriented in parallel planes, said first and second pairs of contact beams projecting toward one another in an alternating, interleaved order.

* * * * *